US009414476B2

(12) United States Patent
Pruemmer et al.

(10) Patent No.: US 9,414,476 B2
(45) Date of Patent: Aug. 9, 2016

(54) METHOD AND DEVICE FOR GENERATING OPTICAL RADIATION BY MEANS OF ELECTRICALLY OPERATED PULSED DISCHARGES

(75) Inventors: Ralf Pruemmer, Geilenkirchen (DE); Ralf Conrads, Kempen (DE); Klaus Bergmann, Herzogenrath (DE); Felix Kuepper, Aachen (DE); Jeroen Jonkers, Berlin (DE)

(73) Assignees: FRAUNHOFER-GESELLSCHAFT ZUR FOERDERUNG DER ANGEWANDTEN FORSCHUNG E.V., Munich (DE); USHIO DENKI KABUSHIKI KAISHA, Tokyo (JP)

( * ) Notice: Subject to any disclaimer, the term of this patent is extended or adjusted under 35 U.S.C. 154(b) by 218 days.

(21) Appl. No.: 14/236,936

(22) PCT Filed: Jun. 12, 2012

(86) PCT No.: PCT/EP2012/002483

§ 371 (c)(1),
(2), (4) Date: Feb. 4, 2014

(87) PCT Pub. No.: WO2013/020613

PCT Pub. Date: Feb. 14, 2013

(65) Prior Publication Data

US 2014/0159581 A1 Jun. 12, 2014

(30) Foreign Application Priority Data

Aug. 5, 2011 (EP) ..... 11006474

(51) Int. Cl.
*H05G 1/46* (2006.01)
*H05G 2/00* (2006.01)

(52) U.S. Cl.
CPC ..... *H05G 1/46* (2013.01); *H05G 2/003* (2013.01); *H05G 2/008* (2013.01)

(58) Field of Classification Search
None
See application file for complete search history.

(56) References Cited

U.S. PATENT DOCUMENTS 7,388,220 B2 * 6/2008 Fomenkov ..... B82Y 10/00 250/493.1
7,630,475 B2 * 12/2009 Neff ..... G03F 7/70033 250/504 R (Continued)

FOREIGN PATENT DOCUMENTS

EP 1 976 344 A2 10/2008 ..... H05G 2/00
WO WO 2005/025280 A2 3/2005 ..... H05G 2/00
WO WO 2010/070540 A1 6/2010 ..... H05G 2/00

OTHER PUBLICATIONS

International Search Report mailed Oct. 16, 2012 in corresponding application No. PCT/EP2012/002483.

(Continued)

*Primary Examiner* — Douglas W Owens
*Assistant Examiner* — Srinivas Sathiraju
(74) *Attorney, Agent, or Firm* — Renner Kenner Greive Bobak Taylor & Weber

(57) ABSTRACT

The present invention relates to a method and device for generating optical radiation (18), in particular EUV radiation or soft x-rays, by means of electrically operated discharges. A plasma (15) is ignited in a gaseous medium between at least two electrodes (1, 2), wherein said gaseous medium is produced at least partly from a liquid material (6), which is applied to one or several surface(s) moving in the discharge space and is at least partially evaporated by one or several pulsed energy beam(s) (9). At least two consecutive pulses (16) are applied within a time interval of each electrical discharge onto said surface(s). The delay between and/or the pulse energy of said consecutive pulses is controlled to stabilize the position of an emission center of the plasma (15).

13 Claims, 2 Drawing Sheets

(56) References Cited

U.S. PATENT DOCUMENTS

| | | | | |
|---|---|---|---|---|
| 7,897,948 | B2 * | 3/2011 | Jonkers | H05G 2/005 250/492.1 |
| 8,040,033 | B2 * | 10/2011 | Zhokhavets | H05G 2/005 313/231.71 |
| 8,253,123 | B2 * | 8/2012 | Jonkers | H05G 2/005 250/365 |
| 2005/0199829 | A1 * | 9/2005 | Partlo | B82Y 10/00 250/504 R |
| 2007/0125970 | A1 * | 6/2007 | Fomenkov | B82Y 10/00 250/504 R |
| 2007/0158596 | A1 * | 7/2007 | Oliver | B82Y 10/00 250/504 R |
| 2007/0158597 | A1 * | 7/2007 | Fomenkov | B82Y 10/00 250/504 R |
| 2008/0017801 | A1 * | 1/2008 | Fomenkov | B82Y 10/00 250/354.1 |
| 2008/0158596 | A1 * | 7/2008 | Kadota | G03G 15/5004 358/1.15 |
| 2008/0187105 | A1 * | 8/2008 | Neff | G03F 7/70033 378/134 |
| 2008/0237501 | A1 * | 10/2008 | Hosokai | B82Y 10/00 250/504 R |
| 2009/0250638 | A1 * | 10/2009 | Jonkers | H05G 2/005 250/493.1 |
| 2011/0133621 | A1 * | 6/2011 | Zhokhavets | H01J 1/88 313/46 |
| 2011/0133641 | A1 * | 6/2011 | Zhokhavets | H05G 2/003 313/631 |
| 2011/0248192 | A1 * | 10/2011 | Jonkers | H05G 2/005 250/504 R |

OTHER PUBLICATIONS

Written Opinion mailed Oct. 16, 2012 in corresponding application No. PCT/EP2012/002483.

* cited by examiner

METHOD AND DEVICE FOR GENERATING OPTICAL RADIATION BY MEANS OF ELECTRICALLY OPERATED PULSED DISCHARGES

CROSS-REFERENCE TO RELATED APPLICATION

This is a §371 application of International patent application number PCT/EP2012/002483 filed Jun. 12, 2012, which claims the benefit of European patent application number 11 006 474.8 filed on Aug. 5, 2011, and which is incorporated herein by reference.

FIELD OF THE INVENTION

The present invention relates to a method and device for generating optical radiation by means of electrically operated pulsed discharges, wherein a plasma is ignited in a gaseous medium between at least two electrodes in a discharge space, said plasma emitting said radiation that is to be generated, wherein said gaseous medium is produced at least partly from a liquid material, which is applied to one or several surface(s) moving in said discharge space and is at least partially evaporated by one or several pulsed energy beam(s), and wherein at least two consecutive pulses of said pulsed energy beam(s) are applied within a time interval of each electrical discharge onto said surface(s) to evaporate said liquid material. Such discharge based light sources when emitting EUV radiation or soft x-rays, in particular in the wavelength range between approximately 1 and 20 nm, are mainly required in the field of EUV lithography and metrology.

BACKGROUND OF THE INVENTION

In EUV lithography the position of the EUV producing plasma has to be stable within roughly a few tens of μm to ensure good imaging properties of the scanner. In a EUV radiation generating device like that known from WO 2005/025280 A2, the position of the emission center of the plasma is determined in two directions by the pointing stability of the trigger laser and in the third direction by the position of the electrode surface from which the metal melt is being evaporated by the same laser. However, this last position is not completely fixed in space since the electrode wheel heats up during operation and thus will expand in radial direction. Due to this the EUV hot spot (emission center of plasma) is shifted towards the other electrode. This would not be a problem in case of steady-state operation, as the position would be constant after a short time that is necessary to reach the thermal steady state. However, in a scanner as known from WO 2005/025280 A2 the light source is switched on and off on a similar time scale, so that the steady state will hardly be reached and the EUV producing plasma is moving continuously.

WO 2010/070540 A1 discloses a method and device for generating EUV radiation with enhanced efficiency using two lasers firing with a small time delay to evaporate the metal melt. The time delay between the two constrictive pulses, which are applied within a time interval of each electrical discharge, is varied in order to achieve a maximum EUV output.

SUMMARY OF THE INVENTION

It is an object of the present invention to provide a method and device for generating optical radiation by means of electrically operated pulsed discharges, in which the position of the emission center of the plasma is stabilized.

The object is achieved with the method and device according to claims 1 and 9. Advantageous embodiments of the method and device are subject of the dependent claims and are furthermore described in the following portions of the description.

In the proposed method a plasma is ignited in a gaseous medium between at least two electrodes in a discharge space, said plasma emitting the radiation that is to be generated. The gaseous medium is produced at least partly from a liquid material, in particular a metal melt, which is applied to one or several surface(s) moving in the discharge space and is at least partially evaporated by one or several pulsed energy beam(s), which may be, for example, ion or electron beams and in a preferred embodiment are laser beams. At least two consecutive pulses of said pulsed energy beam(s) are applied with in a time interval of each electrical discharge onto said surface(s) to evaporate said liquid material. In the proposed method, the position of the emission center of the plasma, i. e. the spatial position of the hot spot, is held constant during a time period covering a multiplicity of said electrical discharges by controlling a time delay between and/or a pulse energy of said at least two consecutive pulses.

The corresponding device comprises at least two electrodes arranged in a discharge space at a distance from one and other with allows ignition of a plasma in a gaseous medium between the electrodes, a device for applying a liquid material to one or several surface(s) moving in said discharge space and an energy beam device adapted to direct one or several pulsed energy beam(s) onto said surfaces evaporating said applied liquid material at least partially and thereby producing at least part of said gaseous medium. The energy beam device is designed to apply within a time interval of each electrical discharge at least two consecutive pulses of the pulsed energy beam(s) onto said surface(s) to evaporate said liquid material. Furthermore, a control unit is designed to control the time delay between and/or the pulse energy of said two consecutive pulses such that the position of the emission center of said plasma is held constant during a time period covering a multiplicity of said electrical discharges. The proposed device may otherwise be constructed like the device described in WO 2005/025280 A2, which is incorporated herein by reference.

In the proposed method and device not only one single energy beam pulse is applied for each electrode discharge, but at least two consecutive pulses are applied within the time interval of each electrical discharge or current pulse. The time interval starts with the application of the first energy beam pulse initiating the corresponding electrical discharge and ends when the capacitor bank is discharged after the corresponding current pulse. The at least two consecutive pulses can be generated by using two separate energy beam sources, in particular laser sources, which have their own trigger in order to achieve the appropriate timing. It is also possible to use only one single energy beam source, the pulsed energy beam of which is split up into two or more partial beams. The delays between the single pulses are then achieved by different delay lines for the different partial beams. Appropriate beam splitters, in particular for laser beams, for splitting up one beam into several partial beams are known in the art. Preferably the two consecutive pulses are applied with a mutual time delay of less equal 300 ns and with a pulse energy ranging from 1 mJ to ≤100 mJ.

Inventors of the present invention discovered that the position of the emission center of the plasma, in particular the distance of this center to the electrode surface, depends on the exact delay between and on the pulse energy of the two consecutive laser pulses. By variation of the time delay and/or pulse energy of the two laser pulses, the emission center of the plasma can be moved up to several tens of millimeters. Such a movement is enough to compensate for the thermal expansion of the electrodes, in particular of the electrode wheel in one of the embodiments of the device. In the present method and device, therefore, the time delay between the two consecutive pulses and/or the pulse energy of these pulses are controlled such that the emission center of the plasma is held constant during a time period which covers a multiplicity of the electrical discharges. The term constant in this context means that the position of the emission center preferably does not move over a distance of >100 μm.

This control can be performed based on measurements of the position of the emission center of the plasma in real time, resulting in a feedback control based on the monitoring. The control can also be based on a change in the position of an edge of at least one of the electrodes which can also be monitored. A further possibility is to monitor the electrical power applied to the electrodes for generating the plasma and to control the time delay and/or energy of the pulses based on the applied electrical power, which is a measure for the dissipated power. The electrical power applied to the electrodes is known from the control of the capacitor bank, i.e. the charging voltage, the capacity of the capacitor bank and the discharge frequency, and can thus be determined without measurement. The last two control mechanisms require the knowledge about the movement of the emission center of the plasma with the applied electrical power or with the movement of the electrode edge, respectively. To this end the dependency of the position of the emission center of the plasma on the time delay and/or pulse energy and on a change in position of said edge of said at least one of said electrodes is measured in advance. In the other case the dependency of the position of the emission center of the plasma on the time delay and/or pulse energy and on the applied electrical power is measured in advance. The measurement results are stored in order to be available for the control during operation of the device. The measurement results can also be evaluated in advance such that the required time delay and/or pulse energy for stabilizing the position of the emission center depending on the movement of said edge or on the applied electrical power is stored.

The proposed device in one embodiment thus comprises a means for monitoring a change in the position of the edge of at least one of said electrodes, wherein the control unit has access to the above stored data about the dependency of the position of the emission center on the time delay and/or pulse energy and on the change in position of said edge of said at least one of said electrodes and is designed to control the time delay and/or pulse energy based on the monitored change in position and the stored data.

In a further embodiment the proposed device comprises means for monitoring the electrical power applied for generating the plasma. In this case the control unit has access to the stored data about the dependency of the position of the emission center of the plasma on the time delay and/or pulse energy and on the applied electrical power and is designed to control the time delay and/or pulse energy based on the applied electrical power and the stored data.

BRIEF DESCRIPTION OF THE DRAWINGS

The proposed method and device are described in the following in connection with the accompanying figures without limiting the scope of the claims. The figures show:

DETAILED DESCRIPTION OF EMBODIMENTS

Figure 1:
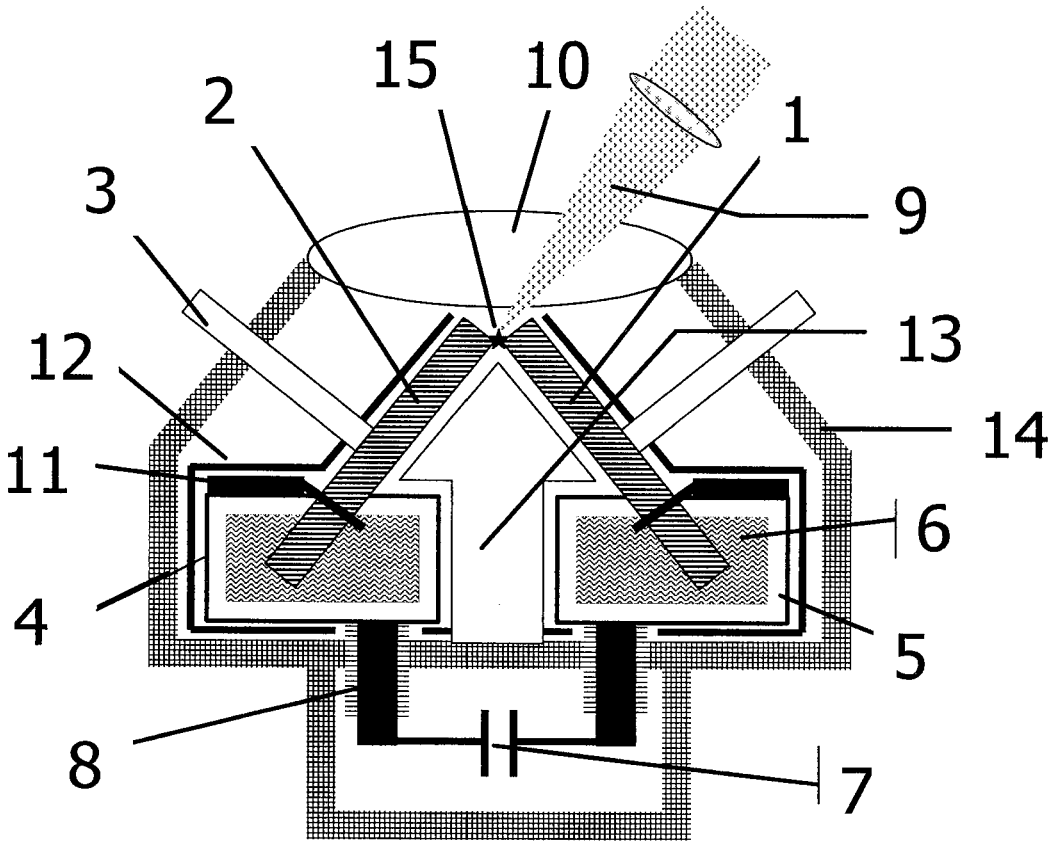
FIG. 1 a schematic view of a device for generating EUV radiation.

FIG. 1 shows a schematic side view of a device for generating EUV radiation or soft x-rays to which the present method can be applied and which may be part of the device of the present invention. The device comprises two electrodes 1, 2 arranged in a vacuum chamber. The disc shaped electrodes 1, 2 are rotatably mounted, i.e. they are rotated during operation about rotational axis 3. During rotation the electrodes 1, 2 partially dip into corresponding containers 4, 5. Each of these containers 4, 5 contains a metal melt 6, in the present case liquid tin. The metal melt 6 is kept on a temperature of approximately 300° C., i.e. slightly above the melting point of 230° C. of tin. The metal melt 6 in the containers 4, 5 is maintained at the above operation temperature by a heating device or a cooling device (not shown in the figure) connected to the containers. During rotation the surface of the electrodes 1, 2 is wetted by the liquid metal so that a liquid metal film forms on said electrodes. The layer thickness of the liquid metal on the electrodes 1, 2 can be controlled by means of strippers 11 typically in the range between 0.5 to 40 μm. The current to the electrodes 1, 2 is supplied via the metal melt 6, which is connected to the capacitor bank 7 via an insulated feed through 8.

The electrode wheels are advantageously arranged in a vacuum system with a basic vacuum of less than $10^{-4}$ hPa. A high voltage can be applied to the electrodes, for example a voltage of between 2 to 10 kV, without causing any uncontrolled electrical breakdown. This electrical breakdown is started in a controlled manner by an appropriate pulse of a pulsed energy beam, in the present example a laser pulse. The laser pulse 9 is focused on one of the electrodes 1, 2 at the narrowest point between the two electrodes, as shown in the figure. As a result, part of the metal film on the electrodes 1, 2 evaporates and bridges over the electrode gap. This leads to a disruptive discharge at this point accompanied by a very high current from the capacitor bank 7. The current heats the metal vapor to such high temperatures that the latter is ionized and emits the desired EUV radiation in pinch plasma 15.

In order to prevent metal vapor from escaping from the device, a debris mitigation unit 10 is arranged in front of the device. In order to avoid the contamination of the housing 14 of the device a screen 12 may be arranged between the electrodes 1, 2 and the housing 14. An additional metal screen 13 may be arranged between the electrodes 1, 2 allowing the condensed metal to flow back into the two containers 4, 5.

Figure 2:
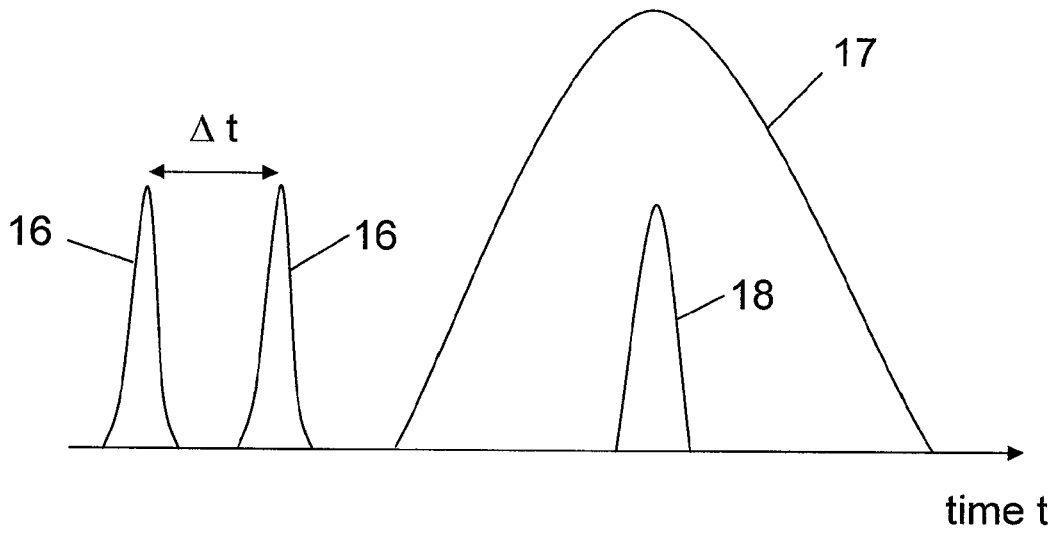
FIG. 2 a schematic diagram showing the time delay between two consecutive pulses applied within the time period of one electrical discharge.

In the proposed method and device, not only one single laser pulse per electrical discharge is used to generate the tin cloud, but at least two consecutive pulses. FIG. 2 shows an embodiment, in which the two consecutive laser pulses 16 with a mutual time delay of approximately 30 ns are used to evaporate the tin. In this diagram, the duration of the electrical current pulse 17 is also indicated as well as time of emission of the EUV radiation 18. In this example, the time between the first of the two laser pulses 16 and the onset of the current 17 is around 100 ns.

The time delay between the two consecutive pulses 16 is controlled in the present method and device in order to hold the position of the emission center of plasma 15 constant. To this end, the position of this emission center may be monitored in real time via an appropriate camera and the time delay and/or pulse energy may then be controlled by an active feedback control. In other embodiments, the control is based on a determination or measurement of the electrical power applied for generating the plasma or on measurements of a movement of the electrode edge near the plasma. The latter measurement may also be performed with a camera. In both cases, calibration measurements have been performed in advance which show the influence of the measured values on the position of the plasma pinch on the one hand and the time delay and/or pulse energy needed to stabilize the position of the emission center in such cases. Based on these calibration measurements and the actual monitoring of the corresponding values, the time delay between the consecutive pulses and/or the pulse energy of the consecutive pulses is varied in order to achieve the stable position of the plasma emission center.

Figure 3:
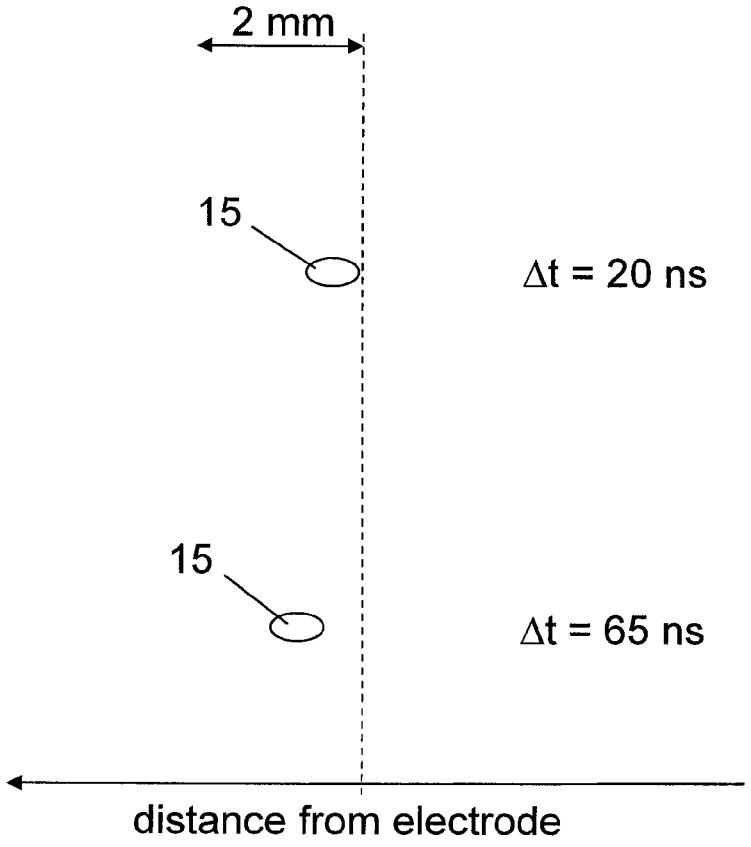
FIG. 3 an image showing the movement of the plasma dependent on the time delay between the consecutive laser pulses.

FIG. 3 shows an example of the influence of the time delay between the two consecutive pulses on the position of the emission center of the plasma 15. In the upper figure the consecutive laser pulses are applied with a time delay of 20 ns, wherein in the lower figure the time delay between the pulses is increased to 65 ns. This increase in time delay results in a movement of the position of the emission center of the plasma 15 about a distance of approximately 300 μm.

While the invention has been illustrated and described in detail in the drawings and foregoing description, such illustration and description are to be considered illustrative or exemplary and not restrictive. The invention is not limited to the disclosed embodiments. The different embodiments described above and in the claims can also be combined. Other variations to the disclosed embodiments can be understood and effected by those skilled in the art in practicing the claimed invention, from the study of the drawings, the disclosure and the appended claims. In the claims, the word "comprising" does not exclude other elements or steps, and the indefinite article "a" or "an" does not exclude a plurality. The mere fact that measures are recited in mutually different dependent claims does not indicate that a combination of these measures cannot be used to advantage. The reference signs in the claims should not be construed as limiting the scope of these claims.

LIST OF REFERENCE SIGNS

1 electrode
2 electrode
3 rotational axis
4 container
5 container
6 metal melt
7 capacitor bank
8 feed through
9 laser pulse
10 debris mitigation unit
11 strippers
12 shield
13 metal screen
14 housing
15 plasma
16 consecutive laser pulses
17 electrical current pulse
18 EUV radiation

What is claimed is:

1. A method of generating optical radiation by means of electrically operated pulsed discharges, in which igniting a plasma in a gaseous medium between at least two electrodes in a discharge space, said plasma emitting said radiation that is to be generated, producing said gaseous medium at least partly from a liquid material, which is applied to one or several surface(s) moving in said discharge space and is at least partially evaporated by one or several pulsed energy beam(s), applying at least two consecutive pulses of said pulsed energy beam(s) within a time interval of each electrical discharge onto said surface(s) to evaporate said liquid material, and controlling a time delay between said at least two consecutive pulses and/or a pulse energy of said at least two consecutive pulses such that a position of an emission center of said plasma is held constant during a time period covering a multiplicity of said electrical discharges.

2. The method according to claim 1, wherein the position of said emission center is monitored and said time delay and/or pulse energy is feedback controlled based on the monitoring.

3. The method according to claim 1, wherein a change in the position of an edge of at least one of said electrodes is monitored and said time delay and/or pulse energy is controlled based on said change in position.

4. The method according to claim 1, wherein electrical power applied for generating the plasma is monitored and said time delay and/or pulse energy is controlled based on the applied electrical power.

5. The method according to claim 3, wherein a dependency of the position of the emission center of said plasma on the time delay and/or pulse energy and on a change in position of said edge of said at least one of said electrodes is measured in advance and said control of the time delay and/or pulse energy is performed based on said measurement.

6. The method according to claim 4, wherein a dependency of the position of the emission center of said plasma on the time delay and/or pulse energy and on the applied electrical power is measured in advance and said control is performed based on said measurement.

7. A method according to claim 1, wherein at least one of said electrodes is set in rotation during operation, said liquid material being applied to a surface of said at least one of said electrodes.

8. The method according to claim 1, wherein said at least two consecutive pulses are applied with a mutual time delay of ≤300 ns and with a pulse energy of between 1 mJ and ≤100 mJ.

9. A device for generating optical radiation by means of electrically operated pulsed discharges, comprising at least two electrodes arranged in a discharge space at a distance from one another which allows ignition of a plasma in a gaseous medium between said electrodes, a device for applying a liquid material to one or several surface(s) moving through said discharge space, an energy beam device adapted to direct one or several pulsed energy beam(s) onto said surface(s) evaporating said applied liquid material at least partially thereby producing at least part of said gaseous medium, said energy beam device being designed to apply within a time interval of each electrical discharge at least two consecutive pulses of said pulsed energy beam(s) onto said surface(s) to evaporate said liquid material, and a control unit designed to control a time delay between and/or a pulse energy of the two consecutive pulses such that a position of an emission center of said plasma is held constant during a time period covering a multiplicity of said electrical discharges.

10. The device according to claim 9, further comprising radiation sensors arranged for monitoring the position of said emission center, said control unit being designed to perform a feedback control of said time delay and/or pulse energy based on the monitoring.

11. The device according to claim 9, further comprising a device for monitoring a change in the position of an edge of at least one of said electrodes, said control unit having access to stored data about a dependency of the position of the emission center of said plasma on the time delay and/or pulse energy and on a change in position of said edge of said at least one of said electrodes and being designed to control said time delay and/or pulse energy based on said monitored change in position and said stored data.

12. The device according to claim 9, further comprising means for monitoring electrical power applied for generating the plasma, said control unit having access to stored data about a dependency of the position of the emission center of said plasma on the time delay and/or pulse energy and on the applied electrical power and being designed to control said time delay and/or pulse energy based on the applied electrical power and said stored data.

13. The device according to claim 9, wherein said device for applying a liquid material is adapted to apply the liquid material to a surface of at least one of said electrodes, said at least one of said electrodes being designed as a rotatable wheel which can be placed in rotation during operation.

* * * * *